US008919839B2

(12) United States Patent
Molteni

(10) Patent No.: US 8,919,839 B2
(45) Date of Patent: Dec. 30, 2014

(54) ELECTROMAGNETIC LIFTER FOR MOVING HORIZONTAL-AXIS COILS AND THE LIKE

(75) Inventor: Danilo Molteni, Manerbio (IT)

(73) Assignee: SGM Gantry S.p.A. (IT)

( * ) Notice: Subject to any disclaimer, the term of this patent is extended or adjusted under 35 U.S.C. 154(b) by 139 days.

(21) Appl. No.: 13/393,494

(22) PCT Filed: Sep. 1, 2009

(86) PCT No.: PCT/IT2009/000393
§ 371 (c)(1),
(2), (4) Date: Feb. 29, 2012

(87) PCT Pub. No.: WO2011/027368
PCT Pub. Date: Mar. 10, 2011

(65) Prior Publication Data
US 2012/0153650 A1 Jun. 21, 2012

(51) Int. Cl.
*B66C 1/06* (2006.01)
*H01F 7/20* (2006.01)

(52) U.S. Cl.
CPC . *B66C 1/06* (2013.01); *H01F 7/206* (2013.01)
USPC ..... 294/65.5; 335/289

(58) Field of Classification Search
CPC ..... B66C 1/06; B66C 1/00; B66C 1/04; H01F 7/206
USPC ..... 294/65.5, 907; 335/282, 285, 287, 289, 335/290
See application file for complete search history.

(56) References Cited

U.S. PATENT DOCUMENTS

| | | | | | |
|---|---|---|---|---|---|
| 2,721,726 | A | * | 10/1955 | Johnson | 175/331 |
| 3,363,209 | A | * | 1/1968 | Pevar | 294/65.5 |
| 3,439,304 | A | * | 4/1969 | Palm | 335/291 |
| 3,557,689 | A | * | 1/1971 | Teplitz | 101/35 |
| 3,596,967 | A | * | 8/1971 | Carter | 294/65.5 |
| 4,422,783 | A | * | 12/1983 | Houk | 400/128 |

(Continued)

FOREIGN PATENT DOCUMENTS

| | | | |
|---|---|---|---|
| CN | 2440790 | Y | 8/2001 |
| JP | 49-050964 | U | 5/1974 |

(Continued)

OTHER PUBLICATIONS

International Search Report for PCT/IT2009/000393.

(Continued)

*Primary Examiner* — Paul T Chin
(74) *Attorney, Agent, or Firm* — Akerman LLP

(57) ABSTRACT

An electromagnetic lifter comprises at least two polar expansions (4), shaped for transporting a horizontal axis coil or the like, arranged perpendicularly to the axis of the coil to be lifted, divided into two halves (4*a*, 4*b*) slidable with respect to each other under the action of an actuator mechanism (5) and shaped so as to be able to penetrate each other. The adjustability of the polar expansions (4) allows them to better adapt to the different diameters of the coils to be lifted, with the result of exploiting the greatest possible useful polar section and of reducing to a minimum the operational air gaps, whereby the lifter need not be oversized to take into account the most unfavourable case and it results smaller, lighter and cheaper.

16 Claims, 3 Drawing Sheets

(56) References Cited

U.S. PATENT DOCUMENTS

| | | | | | |
|---|---|---|---|---|---|
| 4,456,292 | A * | 6/1984 | Haeusler et al. | ..... | 294/65.5 |
| 4,624,617 | A * | 11/1986 | Belna | ..... | 414/935 |
| 4,965,695 | A * | 10/1990 | Baumann | ..... | 361/142 |
| 5,607,281 | A * | 3/1997 | Egolf et al. | ..... | 414/751.1 |
| 6,104,270 | A * | 8/2000 | Elias | ..... | 335/289 |
| 6,994,305 | B2 * | 2/2006 | Schenk, Jr. | ..... | 335/285 |
| 7,396,057 | B2 * | 7/2008 | Ye et al. | ..... | 294/65.5 |
| 8,210,585 | B2 * | 7/2012 | Molteni | ..... | 294/65.5 |
| 2002/0190826 | A1 * | 12/2002 | Molteni | ..... | 335/291 |

FOREIGN PATENT DOCUMENTS

| | | | | | |
|---|---|---|---|---|---|
| JP | 9/77450 | * | 9/1995 | ..... | B66C 1/06 |
| KR | 20040056320 | A | 6/2004 | | |
| KR | 20080002634 | U | 7/2008 | | |
| KR | 20080002782 | U | 7/2008 | | |
| SU | 1757984 | A1 | 8/1992 | | |
| WO | 2009/022357 | A1 | 2/2009 | | |

OTHER PUBLICATIONS

Written Opinion of the International Searching Authority for PCT/IT2009/000393.

* cited by examiner

ELECTROMAGNETIC LIFTER FOR MOVING HORIZONTAL-AXIS COILS AND THE LIKE

This application is a national phase of PCT/IT2009/000393, filed Sep. 1, 2009, the entire contents of which is hereby incorporated by reference.

The present invention relates to lifters used for moving horizontal-axis coils, and in particular to an electromagnetic lifter provided with shaped and adjustable polar expansions. Specific reference will be made hereafter to the moving of horizontal-axis coils, yet it is clear that the present lifter can find application also in the field of moving similar products, such as large-size rounds and tubes with a wide range of diameters.

It is known that the lifters normally used for moving horizontal-axis coils generally consist of a magnet (an electromagnet or an electropermanent magnet) with two symmetrical polarities North/South that extend along the longitudinal axis of the lifter and are arranged to the sides thereof. Said polarities are suitably spaced and involute-shaped so as to fit the largest possible number of diameters of the coils to be moved.

These known lifters have drawbacks caused by the shaping and arrangement of the polarities, which on the other hand are necessary to allow a single lifter to cover a wide range of coil diameters thus permitting the moving thereof.

A first drawback stems from the fact that the above-mentioned structure of the lifter forces it in some cases to operate with quite large air gaps and with reduced areas of contact between the polar expansions and the coil. This compels to design and manufacture lifters that are more powerful, heavier and more expensive in order to take into account these unfavourable operating conditions.

A second drawback is given by the arrangement of the polarities due to which the North-South flux lines, being arranged in planes perpendicular to the axis of the lifted coil that is in the same plane as the lifter axis, are closed tongs-like over the external turns to which the flux is linked thus producing deformations therein. In fact in the coils lifted with this type of apparatus the outermost turns of sheet undergo deformations caused by the magnetic flux, especially when the sheet thickness is <1 mm. In the case of sheet with a higher thickness said alterations remain within the elastic deformation range but they become plastic deformations in the case of lower thickness sheet.

Therefore the object of the present invention is to provide an electromagnetic lifter which is free from said drawbacks. This object is achieved by means of an electromagnetic lifter comprising polar expansions arranged perpendicularly to the axis of the coil to be lifted, divided into two halves slidable with respect to each other under the action of a suitable actuator and shaped so as to be able to penetrate each other.

The fundamental advantage of the present lifter stems from the adjustability of the polar expansions that allows them to better adapt to the different diameters of the coils to be lifted, with the result of exploiting the greatest possible useful polar section and of reducing to a minimum the operational air gap. As a consequence, the lifter need not be oversized to take into account the most unfavourable case and it results smaller, lighter and cheaper (particularly in the case of lifters with electropermanent magnets).

A second significant advantage results from the fact that, thanks to the perpendicular arrangement of the polar expansions, the North-South flux lines are arranged in planes parallel to the coil axis and therefore do not close tongs-like over the external turns to which the flux is linked thus minimizing the risk of producing deformations therein.

Further advantages and characteristics of the lifter according to the present invention will be clear to those skilled in the art from the following detailed description of an embodiment thereof, with reference to the annexed drawings wherein.

Figure 1:
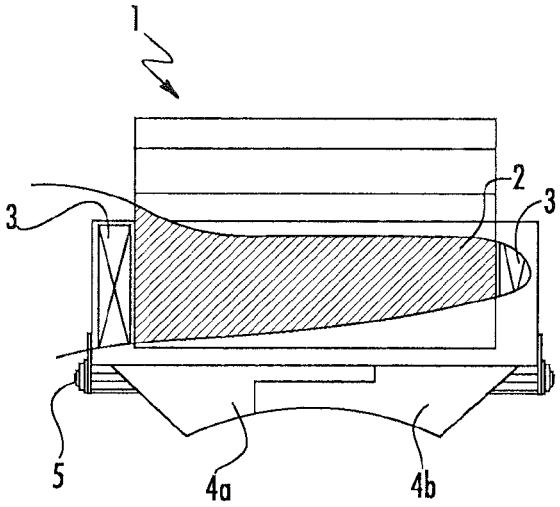
FIG. 1 is a diagrammatic partially sectional front view of a lifter according to the invention in the electromagnet version.
Figure 2:
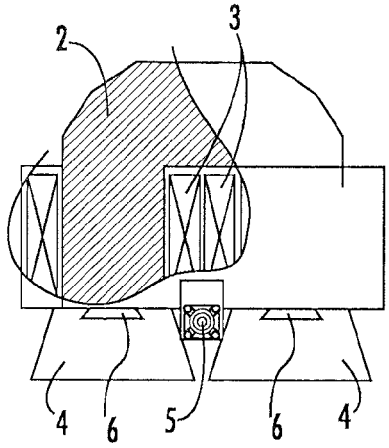
FIG. 2 is a diagrammatic partially sectional lateral view of the lifter of FIG. 1.

Referring first to FIGS. 1-2, there is seen that an electromagnetic lifter 1 according to the present invention conventionally includes a magnetic yoke 2 having an inverted U shape so as to define a North-South magnetic dipole. Two solenoids 3 are wound around the cores of yoke 2 to generate the magnetomotive force required to lift the load, said solenoids 3 being preferably of anodised aluminium in order to optimize their performance and in particular the dissipation of the heat generated by Joule effect. Two polar expansions 4, shaped for transporting a horizontal-axis coil, are arranged at the ends of yoke 2.

It should be noted that although electromagnet 1 described here is preferably bipolar said choice is not binding, since magnets with different numbers of poles properly provided with the required elements can be manufactured by the same principle.

A first novel aspect of the present lifter resides in the fact that each polar expansion 4 is divided into two halves 4*a*, 4*b* slidable with respect to each other and shaped so as to be able to penetrate each other, as it will be better described further on. Each of the two halves 4*a*, 4*b* has its active surface, i.e. the surface contacting the load, worked with a continuous radius having a value equal to the maximum radius of the coils to be lifted.

The sliding movement is achieved by means of a power-driven mechanism 5, preferably located between the two polar expansions 4, that allows the latter, which slide along dovetail guides 6, to change the profile of their shaping according to the diameter of the coil. For example, mechanism 5 can be of the hydraulic type or with motor-reducers and actuators, and it is possibly controlled by an encoder or other similar device capable of pre-setting the coil diameter and adjusting the polar expansions 4 for lifting the selected coil.

A second novel aspect of the lifter above, as previously mentioned, is the arrangement of the polar expansions 4 in a direction perpendicular with respect to the horizontal axis of the coil to be lifted, as it will be better illustrated in the following.

Figure 3:
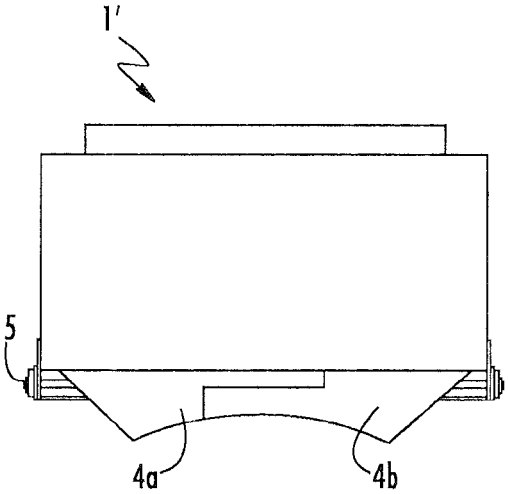
FIG. 3 is a diagrammatic front view of a lifter according to the invention in the electropermanent magnet version.
Figure 4:
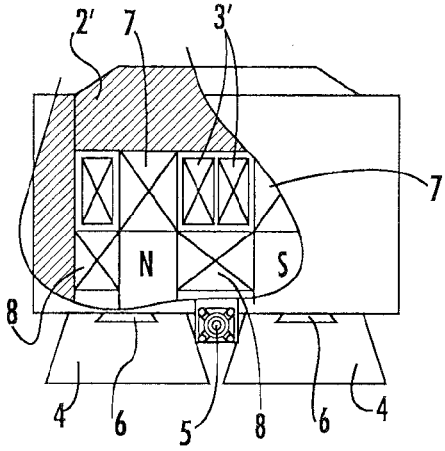
FIG. 4 is a diagrammatic partially sectional lateral view of the lifter of FIG. 3.

The electropermanent magnet version of the above-mentioned lifter is illustrated in FIGS. 3-4, where the unchanged reference numerals indicate the elements in common between the two versions, namely the novel portion of the polar expansions 4 and of the relevant adjusting members 5, 6.

In practice, the only differences of lifter 1' consist in a yoke 2' having a slightly different shape that houses the conventional magnetic bicomposites 7, 8 respectively formed by Alnico and strontium ferrite or Alnico and rare earths (preferably neodymium). Two solenoids 3', of copper or anodised aluminium or the like, orientate the two Alnico masses forming the so-called reversible magnetic blocks 7 to switch the electropermanent magnet 1' between the active state and the rest state.

Figure 5:
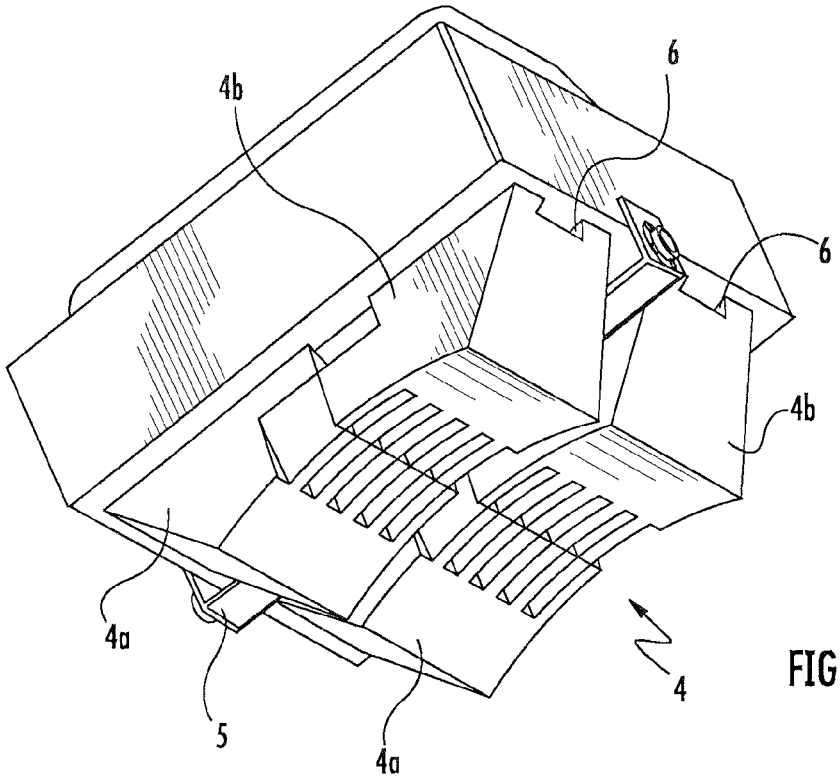
FIG. 5 is a perspective bottom view of the lifter of FIG. 1 with the polar expansions in the fully extended position.
Figure 6:
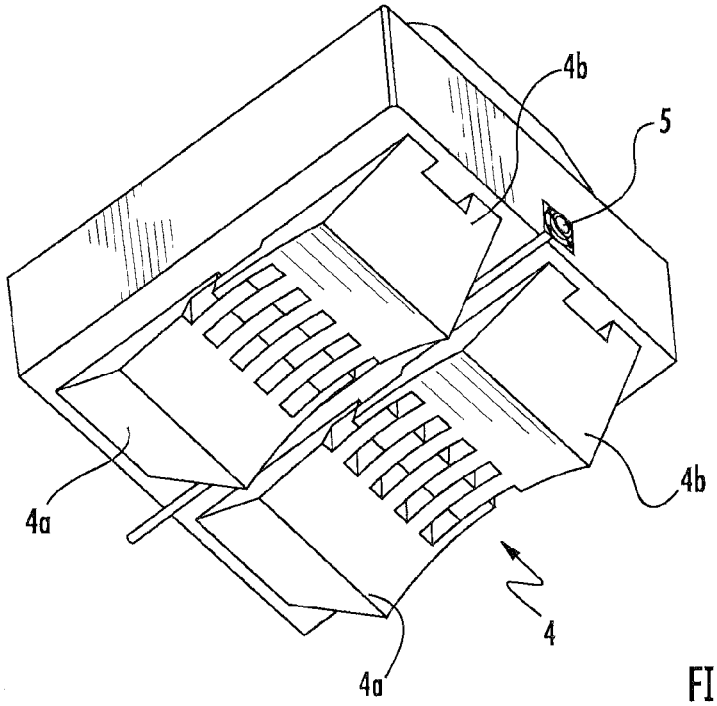
FIG. 6 is a view similar to the preceding one that shows the polar expansions in a partially extended position.
Figure 7:
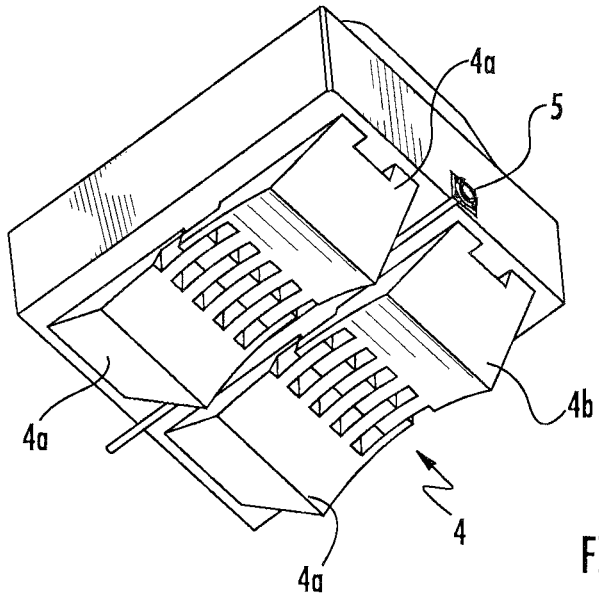
FIG. 7 is a view similar to the preceding one that shows the polar expansions in the fully retracted position.

The adjustment of the polar expansions 4 will now be illustrated in greater detail with reference to FIGS. 5-7, which though illustrating lifter 1 equally apply also to lifter 1'.

The surface in the central region of the polar expansions 4 starting from the longitudinal axis of the lifter is discontinuous in that each of the two halves 4*a*, 4*b* is comb-shaped with equal teeth and a constant pitch. The first half 4*a* has a shape substantially symmetrical and corresponding with the second half 4*b*, which has its teeth offset by one pitch so that it can perfectly penetrate the first half 4*a*.

The sliding movement of the two halves 4*a*, 4*b* of the North polarity, which is synchronous with that of the two halves of the South polarity, allows them to adapt to the different diameters of the coils to be moved. The fully extended position of FIG. 5 corresponds to the maximum diameter and the fully retracted position of FIGS. 1, 3 and 7 corresponds to the minimum diameter, while the intermediate position of FIG. 6 obviously corresponds to an intermediate diameter.

The total sliding run of the two halves 4*a*, 4*b* of each polar expansion 4 is indicatively of the order of 150-250 mm (75-125 mm for each half) in the case of large-size magnets.

Figure 8:
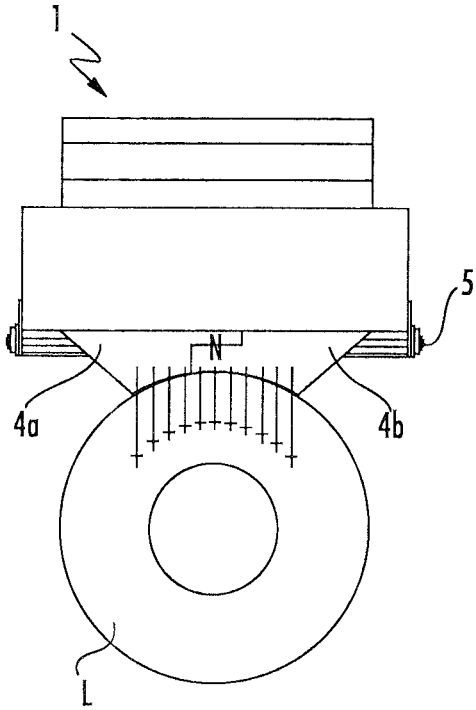
FIG. 8 is a view similar to FIG. 1 that diagrammatically shows the operation of the lifter.
Figure 9:
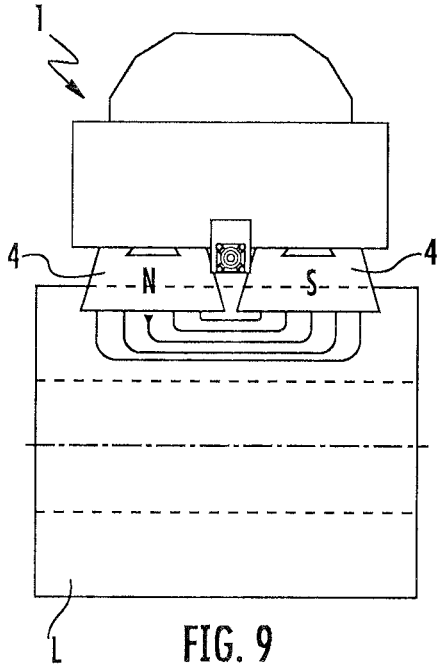
FIG. 9 is a view similar to FIG. 2 that diagrammatically shows the operation of the lifter.

The operation of the present lifter is therefore quite simple and effective and is readily understood from the description above and from FIGS. 8-9.

The polar expansions 4, after adjustment of the position of the two halves 4*a*, 4*b* according to the diameter of the load L to be lifted, get into contact with the horizontal-axis, coil and, upon activation of solenoids 3/3', the flux lines link to load L as shown in FIG. 9.

This novel arrangement assures a coupling between the active surface of the lifter and the coil such that the difference between the maximum and minimum active surface is quite low, namely of the order of 15-20% (maximum useful polar section 100%, minimum 80-85%). This means that the force of the magnet at the extremes of the lifter operating range changes about by the same percentage (15-20%), and the amount of said percentage change is much lower than the amount of the percentage change of known lifters in which the difference in useful polar section can be of the order of 70-80% (max. 100%, min. 20-30%).

As a consequence, a lifter according to the present invention can be designed to have on one hand much higher performance and on the other hand a significantly lower weight and therefore cost. To support this statement, some indicative figures of the quantities being treated are given hereunder to perform a comparison with prior art lifters.

The coils of ferromagnetic steel sheet are produced in a very wide range of characteristics, size and weight, with sheet thickness from 0.2 to 20 mm, external diameter of the coil between 900 and 2600 mm and weight between 2 and 45 t (it should be noted that to the decrease of the coil diameter does not correspond an indicatively quadratic decrease of the weight).

In order to guarantee a safe moving of such a range of coils with a conventional lifter it is necessary to design and manufacture a lifter with polar expansions increased about by 50%, considering that the electromagnet must have an anchorage force equal at least to twice the maximum considered load according to the EN 13155 standard.

This results in a lifter that when designed according to conventional knowledge, for example in the electromagnet version, requires about 15 kW of applied power at 220 V and weighs about 8 t. A similar lifter according to the present invention requires a power of about 12 kW and weighs about 6.5 t, i.e. a 20% decrease both in required power and weight. It should also be noted that the oversizing required to the conventional electromagnet not only proportionally increases the costs but it increases as well the problem of the deformation of the external turns of the coil.

The improvement in performance achieved by the new structure and arrangement of the polarities allows an extremely significant decrease in size and weight, which is particularly useful in the application of the present lifter to automatic storage systems. This fact also allows to build a magnet suitable to move coils of different diameter with absolute safety without being compelled to size the magnet for the most unfavourable case (usually consisting of rather small coils yet with a high weight).

It is clear that the above-described and illustrated embodiment of the lifter according to the invention is just an example susceptible of various modifications. In particular, the exact shape of the two halves 4*a*, 4*b* can be different from the above-illustrated comb shape as long as the two parts are complementary, for example the teeth could not all be identical and with constant pitch, and also guides 6 could have a different shape (e.g. T-shaped or the like), while the relevant actuator mechanism 5 could be located at a different position.

The invention claimed is:

1. An electromagnetic lifter comprising:

at least two polar expansions shaped for transporting a horizontal axis coil, wherein said at least two polar expansions are connected to an electromagnet or to an electropermanent magnet, wherein the polar expansions are arranged perpendicularly to the axis of the coil to be lifted and each polar expansion is divided into two halves, and wherein the two halves of each polar expansion are slidable with respect to each other under the action of an actuator mechanism and are shaped so as to be able to penetrate each other.

2. The electromagnetic lifter according to claim 1, wherein each of the two halves has its active surface worked with a continuous radius having a value equal to the maximum radius of the coils to be lifted.

3. The electromagnetic lifter according to claim 2, wherein the two halves slide on guides shaped as a dovetail or a T.

4. The electromagnetic lifter according to claim 2, wherein the actuator mechanism is located between the two polar expansions.

5. The electromagnetic lifter according to claim 2, wherein the actuator mechanism is controlled by an encoder or other similar device capable of pre-setting the diameter of the coil to be lifted and accordingly adjust the polar expansions.

6. The electromagnetic lifter according to claim 2, wherein the surface in the central region of the polar expansions starting from the longitudinal axis of the lifter is comb-shaped with equal teeth and a constant pitch, the first half of each polar expansion having a shape substantially symmetrical and corresponding with the second half, which has its teeth offset by one pitch.

7. The electromagnetic lifter according to claim 1, wherein the two halves slide on guides shaped as a dovetail or a T.

8. The electromagnetic lifter according to claim 7, wherein the actuator mechanism is located between the two polar expansions.

9. Electromagnetic lifter according to claim 7, wherein the actuator mechanism is controlled by an encoder or other similar device capable of pre-setting the diameter of the coil to be lifted and accordingly adjust the polar expansions.

10. The electromagnetic lifter according to claim 7, wherein the surface in the central region of the polar expansions starting from the longitudinal axis of the lifter is comb-shaped with equal teeth and a constant pitch, the first half of each polar expansion having a shape substantially symmetrical and corresponding with the second half, which has its teeth offset by one pitch.

11. The electromagnetic lifter according to claim 1, wherein the actuator mechanism is located between the two polar expansions.

12. The electromagnetic lifter according to claim 11, wherein the actuator mechanism is controlled by an encoder or other similar device capable of pre-setting the diameter of the coil to be lifted and accordingly adjust the polar expansions.

13. The electromagnetic lifter according to claim 11, wherein the surface in the central region of the polar expansions starting from the longitudinal axis of the lifter is comb-shaped with equal teeth and a constant pitch, the first half of each polar expansion having a shape substantially symmetrical and corresponding with the second half, which has its teeth offset by one pitch.

14. The electromagnetic lifter according to claim 1, wherein the actuator mechanism is controlled by an encoder or other similar device capable of pre-setting the diameter of the coil to be lifted and accordingly adjust the polar expansions.

15. The electromagnetic lifter according to claim 14, wherein the surface in the central region of the polar expansions starting from the longitudinal axis of the lifter is comb-shaped with equal teeth and a constant pitch, the first half of each polar expansion having a shape substantially symmetrical and corresponding with the second half, which has its teeth offset by one pitch.

16. The electromagnetic lifter according to claim 1, wherein the surface in the central region of the polar expansions starting from the longitudinal axis of the lifter is comb-shaped with equal teeth and a constant pitch, the first half of each polar expansion having a shape substantially symmetrical and corresponding with the second half, which has its teeth offset by one pitch.

* * * * *